US005787390A

United States Patent [19]

Quinquis et al.

[11] Patent Number: 5,787,390

[45] Date of Patent: Jul. 28, 1998

[54] METHOD FOR LINEAR PREDICTIVE ANALYSIS OF AN AUDIOFREQUENCY SIGNAL, AND METHOD FOR CODING AND DECODING AN AUDIOFREQUENCY SIGNAL INCLUDING APPLICATION THEREOF

[75] Inventors: Catherine Quinquis; Alain Le Guyader, both of Lannion, France

[73] Assignee: France Telecom, Paris, France

[21] Appl. No.: 763,457

[22] Filed: Dec. 11, 1996

[30] Foreign Application Priority Data

Dec. 15, 1995 [FR] France ..... 95 14925

[51] Int. Cl.[6] ..... G10L 3/02; G10L 5/00

[52] U.S. Cl. ..... 704/219; 704/220; 704/262; 704/205; 704/222; 704/223

[58] Field of Search ..... 704/219, 262, 704/205, 222, 223

[56] References Cited

U.S. PATENT DOCUMENTS

| | | | |
|---|---|---|---|
| 3,975,587 | 8/1976 | Dunn et al. | 704/200 |
| 4,868,867 | 9/1989 | Davidson et al. | 381/36 |
| 5,027,404 | 6/1991 | Taguchi | 381/37 |
| 5,140,638 | 8/1992 | Moulsley et al. | 381/36 |
| 5,142,581 | 8/1992 | Tokuda et al. | 381/36 |
| 5,307,441 | 4/1994 | Tzeng | 704/222 |
| 5,321,793 | 6/1994 | Drogo De Iacovo et al. | 704/220 |
| 5,327,519 | 7/1994 | Haggvist et al. | 704/219 |
| 5,692,101 | 11/1997 | Gerson | 704/222 |
| 5,706,395 | 4/1998 | Arslan | 704/226 |

FOREIGN PATENT DOCUMENTS

| | | | |
|---|---|---|---|
| 2 284 946 | 4/1976 | France | G10L 1/08 |
| 83 02346 | 7/1983 | WIPO | G10L 1/00 |

OTHER PUBLICATIONS

ICASSP'94, IEEE International Conference on Acoustics, Speech and Signal Processing, Apr. 1994—"A novel split residual vector quantization scheme for low bit rate speech coding"—Kwok-Wah Law et al—pp. I/493–496 vol.1.

Speech Processing 1, May 1991, Institute of Electrical and Electronics Engineers—"Low-delay code-excited linear--predictive coding of wide band speech at 32 KBPS"—Ordentlich et al, pp. 9–12.

Seventh International Congress on Acoustics, Budapest, 1971—"Digital filtering techniques for speech analysis and synthesis"—Itakura et al—paper 25C1, pp. 261–264.

"Progress in the development of a digital vocoder employing an Itakura adaptive prediction"—Dunn et al, Proc. of the IEEE National Telecommunication Conference, vol.2, Dec. 1973, pp. 29B–1/29B–6.

*Primary Examiner*—David R. Hudspeth
*Assistant Examiner*—Daniel Abebe
*Attorney, Agent, or Firm*—Larson & Taylor

[57] ABSTRACT

The linear predictive analysis method is used in order to determine the spectral parameters representing the spectral envelope of the audiofrequency signal. This method comprises q successive prediction stages, q being an integer greater than 1. At each prediction stage $p(1 \leqq p \leqq q)$, parameters are determined representing a predefined number Mp of linear prediction coefficients $a_1^p, \ldots, a_{Mp}^p$ of an input signal of the said stage. The audiofrequency signal to be analysed constitutes the input signal of the first stage. The input signal of a stage p+1 consists of the input signal of the stage p filtered with a filter with transfer function $$A^p(z) = 1 + \sum_{i=1}^{Mp} a_i^p \cdot z^{-i}.$$

22 Claims, 5 Drawing Sheets

METHOD FOR LINEAR PREDICTIVE ANALYSIS OF AN AUDIOFREQUENCY SIGNAL, AND METHOD FOR CODING AND DECODING AN AUDIOFREQUENCY SIGNAL INCLUDING APPLICATION THEREOF

BACKGROUND OF THE INVENTION

The present invention relates to a method for linear predictive analysis of an audiofrequency signal. This method finds a particular, but not exclusive, application in predictive audio coders, in particular in analysis-by-synthesis coders, of which the most widespread type is the CELP ("Code-Excited Linear Prediction") coder.

Analysis-by-synthesis predictive coding techniques are currently very widely used for coding speech in the telephone band (300–3400 Hz) at rates as low as 8 kbit/s while retaining telephony quality. For the audio band (of the order of 20 kHz), transform coding techniques are used for applications involving broadcasting and storing voice and music signals. However, these techniques have relatively large coding delays (more than 100 ms), which in particular raises difficulties when participating in group communications where interactivity is very important. Predictive techniques produce a smaller delay, which depends essentially on the length of the linear predictive analysis frames (typically 10 to 20 ms), and for this reason find applications even for coding voice and/or music signals having a greater bandwidth than the telephone band.

The predictive coders used for bit rate compression model the spectral envelope of the signal. This modelling results from a linear predictive analysis of order M (typically M=10 for narrow band), consisting in determining M linear predictive coefficients $a_i$ of the input signal. These coefficients characterize a synthesis filter used in the decoder whose transfer function is of the form 1/A(z) with $$A(z) = 1 + \sum_{i=1}^{M} a_i z^{-i} \tag{1}$$

Linear predictive analysis has a wider general field of application than speech coding. In certain applications, the prediction order M constitutes one of the variables which the linear predictive analysis aims to obtain, this variable being influenced by the number of peaks present in the spectrum of the signal analysed (see U.S. Pat. No. 5,142,581).

The filter calculated by the linear predictive analysis may have various structures, leading to different choices of parameters for representing the coefficients (the coefficients $a_i$ themselves, the LAR, LSF, LSP parameters, the reflection or PARCOR coefficients, etc.). Before the advent of digital signal processors (DSP), recursive structures were commonly employed for the calculated filter, for example structures employing PARCOR coefficients of the type described in the article by F. Itakura and S. Saito "Digital Filtering Techniques for Speech Analysis and Synthesis", Proc. of the 7th International Congress on Acoustics, Budapest 1971, pages 261–264 (see FR-A-2,284,946 or U.S. Pat. No. 3,975,587).

In analysis-by-synthesis coders, the coefficients $a_i$ are also used for constructing a perceptual weighting filter used by the coder to determine the excitation signal to be applied to the short-term synthesis filter in order to obtain a synthetic signal representing the speech signal. This perceptual weighting accentuates the portions of the spectrum where the coding errors are most perceptible, that is to say the interformant regions. The transfer function W(z) of the perceptual weighting filter is usually of the form $$W(z) = \frac{A(z/\gamma_1)}{A(z/\gamma_2)} \tag{2}$$

where $\gamma_1$ and $\gamma_2$ are two spectral expansion coefficients such that $0 \leqq \gamma_2 \leqq \gamma_1 \leqq 1$. An improvement in the noise masking was provided by E. Ordentlich and Y. Shoham in their article "Low-Delay Code-Excited Linear Predictive Coding of Wideband Speech at 32 kbps", Proc. ICASSP, Toronto, May 1991, pages 9–12. This improvement consists, for the perceptual weighting, in combining the filter W(z) with another filter modelling the tilt of the spectrum. This improvement is particularly appreciable in the case of coding signals with a high spectral dynamic range (wideband or audio band) for which the authors have shown a significant improvement in the subjective quality of the reconstructed signal.

In most current CELP decoders, the linear prediction coefficients $a_i$ are also used to define a postfilter serving to attenuate the frequency regions between the formants and the harmonics of the speech signal, without altering the tilt of the spectrum of the signal. One conventional form of the transfer function of this postfilter is:

$$H_{PF}(z) = G_P \frac{A(z/\beta_1)}{A(z/\beta_2)} (1 - \mu r_1 z^{-1}) \tag{3}$$

where $G_p$ is a gain factor compensating for the attenuation of the filters, $\beta_1$, and $\beta_2$ are coefficients such that $0 \leqq \beta_1 \leqq \beta_2 \leqq 1$, $\mu$ is a positive constant and $r_1$ denotes the first reflection coefficient depending on the coefficients $a_i$.

Modelling the spectral envelope of the signal by the coefficients $a_i$ therefore constitutes an essential element in the coding and decoding process, insofar as it should represent the spectral content of the signal to be reconstructed in the decoder and it controls both the quantizing noise masking and the postfiltering in the decoder.

For signals with a high dynamic spectral range, the linear predictive analysis conventionally employed does not faithfully model the envelope of the spectrum. Speech signals are often substantially more energetic at low frequencies than at high frequencies, so that, although linear predictive analysis does lead to precise modelling at low frequencies, this is at the cost of the spectrum modelling at higher frequencies. This drawback becomes particularly problematic in the case of wideband coding.

One object of the present invention is to improve the modelling of the spectrum of an audiofrequency signal in a system employing a linear predictive analysis method. Another object is to make the performance of such a system more uniform for different input signals (speech, music, sinusoidal, DTMF signals, etc.), different bandwidths (telephone band, wideband, hifi band, etc.), different recording (directional microphone, acoustic antenna, etc.) and filtering conditions.

SUMMARY OF THE INVENTION

The invention thus proposes a method for linear predictive analysis of an audiofrequency signal, in order to determine spectral parameters dependent on a short-term spectrum of the audiofrequency signal, the method comprising q successive prediction stages, q being an integer greater than 1. At each prediction stage $p(1 \leqq p \leqq q)$, parameters are determined representing a predefined number Mp of linear prediction coefficients $a_1^p, \ldots, a_{Mp}^p$ of an input signal of said stage, the audiofrequency signal analysed constituting the input signal of the first stage, and the input signal of a stage p+1 consisting of the input signal of the stage p filtered by a filter with transfer function $$A^p(z) = 1 + \sum_{i=1}^{Mp} a_i^p \cdot z^{-i}. \tag{4}$$

The number Mp of linear prediction coefficients may, in particular, increase from one stage to the next. Thus, the first stage will be able to account fairly faithfully for the general tilt of the spectrum or signal, while the following stages will refine the representation of the formants of the signal. In the case of signals with a high dynamic range, this avoids privileging the most energetic regions too much, at the risk of mediocre modelling of the other frequency regions which may be perceptually important.

A second aspect of the invention relates to an application of this linear predictive analysis method in a forward-adaptation analysis-by-synthesis audiofrequency coder. The invention thus proposes a method for coding an audiofrequency signal comprising the following steps:

linear predictive analysis of an audiofrequency signal digitized in successive frames in order to determine parameters defining a short-term synthesis filter;

determination of excitation parameters defining an excitation signal to be applied to the short-term synthesis filter in order to produce a synthetic signal representing the audiofrequency signal; and production of quantization values of the parameters defining the short-term synthesis filter and of the excitation parameters, in which the linear predictive analysis is a process with q successive stages as it is defined above, and in which the short-term prediction filter has a transfer function of the form 1/A(z) with $$A(z) = \prod_{p=1}^{q} A^p(z) \tag{5}$$

The transfer function A(z) thus obtained can also be used, according to formula (2) to define the transfer function of the perceptual weighting filter when the coder is an analysis-by-synthesis coder with closed-loop determination of the excitation signal. Another advantageous possibility is to adopt spectral expansion coefficients $\gamma_1$ and $\gamma_2$ which can vary from one stage to the next, that is to say to give the perceptual weighting filter a transfer function of the form $$W(z) = \prod_{p=1}^{q} [A^p(z/\gamma_1^p)/A^p(z/\gamma_2^p)], \tag{6}$$

where $\gamma_1^p$, $\gamma_2^p$ denote pairs of spectral expansion coefficients such that $0 \leqq \gamma_2^p \leqq \gamma_1^p \leqq 1$ for $1 \leqq p \leqq q$.

The invention can also be employed in an associated decoder. The decoding method thus employed according to the invention comprises the following steps:

quantization values of parameters defining a short-term synthesis filter, and excitation parameters are received, the parameters defining the short-term synthesis filter comprising a number q>1 of sets of linear prediction coefficients, each set including a predefined number of coefficients;

an excitation signal is produced on the basis of the quantization values of the excitation parameters;

a synthetic audiofrequency signal is produced by filtering the excitation signal with a synthesis filter having a transfer function of the form 1/A(z) with $$A(z) = \prod_{p=1}^{q} \left(1 + \sum_{i=1}^{Mp} a_i^p \cdot z^{-i}\right) \tag{7}$$

where the coefficients $a_1^p, \ldots, a_{Mp}^p$ correspond to the p-th set of linear prediction coefficients for $1 \leqq p \leqq q$.

This transfer function A(z) may also be used to define a postfilter whose transfer function includes, as in formula (3) above, a term of the form $A(z/\beta_1)/A(z/\beta_2)$, where $\beta_1$ and $\beta_2$ denote coefficients such that $0 \leqq \beta_1 \leqq \beta_2 \leqq 1$.

One advantageous variant consists in replacing this term in the transfer function of the postfilter by:

$$\prod_{p=1}^{q} [A^p(z/\beta_1^p)/A^p(z/\beta_2^p)], \tag{8}$$

where $\beta_1^p$, $\beta_2^p$ denote pairs of coefficients such that $0 \leqq \beta_1^p \leqq \beta_2^p \leqq 1$ for $1 \leqq p \leqq q$.

The invention also applies to backward-adaptation audiofrequency coders. The invention thus proposes a method for coding a first audiofrequency signal digitized in successive frames, comprising the following steps:

linear predictive analysis of a second audiofrequency signal in order to determine parameters defining a short-term synthesis filter;

determination of excitation parameters defining an excitation signal to be applied to the short-term synthesis filter in order to produce a synthetic signal representing the first audiofrequency signal, this synthetic signal constituting the said second audiofrequency signal for at least one subsequent frame; and production of quantization values of the excitation parameters, in which the linear predictive analysis is a process with q successive stages as it is defined above, and in which the short-term prediction filter has a transfer function of the form 1/A(z) with $$A(z) = \prod_{p=1}^{q} A^p(z)$$

For implementation in an associated decoder, the invention proposes a method for decoding a bit stream in order to construct in successive frames an audiofrequency signal coded by said bit stream, comprising the following steps:

quantization values of excitation parameters are received;

an excitation signal is produced on the basis of the quantization values of the excitation parameters;

a synthetic audiofrequency signal is produced by filtering the excitation signal with a short-term synthesis filter;

linear predictive analysis of the synthetic signal is carried out in order to obtain coefficients of the short-term synthesis filter for at least one subsequent frame, in which the linear predictive analysis is a process with q successive stages as it is defined above, and in which the short-term prediction filter has a transfer function of the form 1/A(z) with $$A(z) = \prod_{p=1}^{q} A^p(z)$$

The invention furthermore makes it possible to produce mixed audiofrequency coders/decoders, that is to say ones which resort both to forward and backward adaptation schemes, the first linear prediction stage or stages corresponding to forward analysis, and the last stage or stages corresponding to backward analysis. The invention thus proposes a method for coding a first audiofrequency signal digitized in successive frames, comprising the following steps:

linear predictive analysis of the first audiofrequency signal in order to determine parameters defining a first component of a short-term synthesis filter;

determination of excitation parameters defining an excitation signal to be applied to the short-term synthesis filter in order to produce a synthetic signal representing the first audiofrequency signal;

production of quantization values of the parameters defining the first component of the short-term synthesis filter and of the excitation parameters, filtering of the synthetic signal with a filter with transfer function corresponding to the inverse of the transfer function of the first component of the short-term synthesis filter; and linear predictive analysis of the filtered synthetic signal in order to obtain coefficients of a second component of the short-term synthesis filter for at least one subsequent frame, in which the linear predictive analysis of the first audiofrequency signal is a process with $q_F$ successive stages, $q_F$ being an integer at least equal to 1, said process with $q_F$ stages including, at each prediction stage $p(1 \leqq p \leqq q_F)$, determination of parameters representing a predefined number $MF_p$ of linear prediction coefficients $a_1^{F,p}, \ldots, a_{MFp}^{F,p}$ of an input signal of said stage, the first audiofrequency signal constituting the input signal of the first stage, and the input signal of a stage p+1 consisting of the input signal of the stage p filtered by a filter with transfer function $$A^{F,p}(z) = 1 + \sum_{i=1}^{MFp} a_i^{F,p} \cdot z^{-i},$$

the first component of the short-term synthesis filter having a transfer function of the form $1/A^F(z)$ with $$A^F(z) = \prod_{p=1}^{q_F} A^{F,p}(z),$$

and in which the linear predictive analysis of the filtered synthetic signal is a process with $q_B$ successive stages, $q_B$ being an integer at least equal to 1, said process with $q_B$ stages including, at each prediction stage $p(1 \leqq p \leqq q_B)$, determination of parameters representing a predefined number $MB_p$ of linear prediction coefficients $a_1^{B,p}, \ldots, a_{MBp}^{B,p}$ of an input signal of said stage, the filtered synthetic signal constituting the input signal of the first stage, and the input signal of a stage p+1 consisting of the input signal of the stage p filtered by a filter with transfer function $$A^{B,p}(z) = 1 + \sum_{i=1}^{MBp} a_i^{B,p} \cdot z^{-i},$$

the second component of the short-term synthesis filter having a transfer function of the form $1/A^B(z)$ with $$A^B(z) = \prod_{p=1}^{q_B} A^{B,p}(z),$$

and the short-term synthesis filter having a transfer function of the form $1/A(z)$ with $A(z)=A^F(z).A^B(z)$.

For implementation in an associated mixed decoder, the invention proposes a method for decoding a bit stream in order to construct in successive frames an audiofrequency signal coded by said bit stream, comprising the following steps:

quantization values of parameters defining a first component of a short-term synthesis filter and excitation parameters are received, the parameters defining the first component of the short-term synthesis filter representing a number $q_F$ at least equal to 1 of sets of linear prediction coefficients $a_1^{F,p}, \ldots, a_{MFp}^{F,p}$ for $1 \leqq p \leqq q_F$, each set p including a predefined number MFp of coefficients, the first component of the short-term synthesis filter having a transfer function of the form $1/A^F(z)$ with $$A^F(z) = \prod_{p=1}^{q_F} A^{F,p}(z) = \prod_{p=1}^{q_F} \left(1 + \sum_{i=1}^{MFp} a_i^{F,p} \cdot z^{-i}\right);$$

an excitation signal is produced on the basis of the quantization values of the excitation parameters;

a synthetic audiofrequency signal is produced by filtering the excitation signal with a short-term synthesis filter with transfer function $1/A(z)$ with $A(z)=A^F(z).A^B(z)$, $1/A^B(z)$ representing the transfer function of a second component of the short-term synthesis filter;

the synthetic signal is filtered with a filter with transfer function $A^F(z)$; and a linear predictive analysis of the filtered synthetic signal is carried out in order to obtain coefficients of the second component of the short-term synthesis filter for at least one subsequent frame, in which the linear predictive analysis of the filtered synthetic signal is a process with $q_B$ stages as it is defined above, and in which the short-term synthesis filter has a transfer function of the form $1/A(z)=1/[A^F(z).A^B(z)]$ with $$A^B(z) = \prod_{p=1}^{q_B} A^{B,p}(z)$$

Although particular importance is attached to applications of the invention in the field of analysis-by-synthesis coding/decoding, it should be pointed out that the multi-stage linear predictive analysis method proposed according to the invention has many other applications in audiosignal processing, for example in transform predictive coders, in speech recognition systems, in speech enhancement systems, etc.

DESCRIPTION OF PREFERRED EMBODIMENTS

Figure 1:
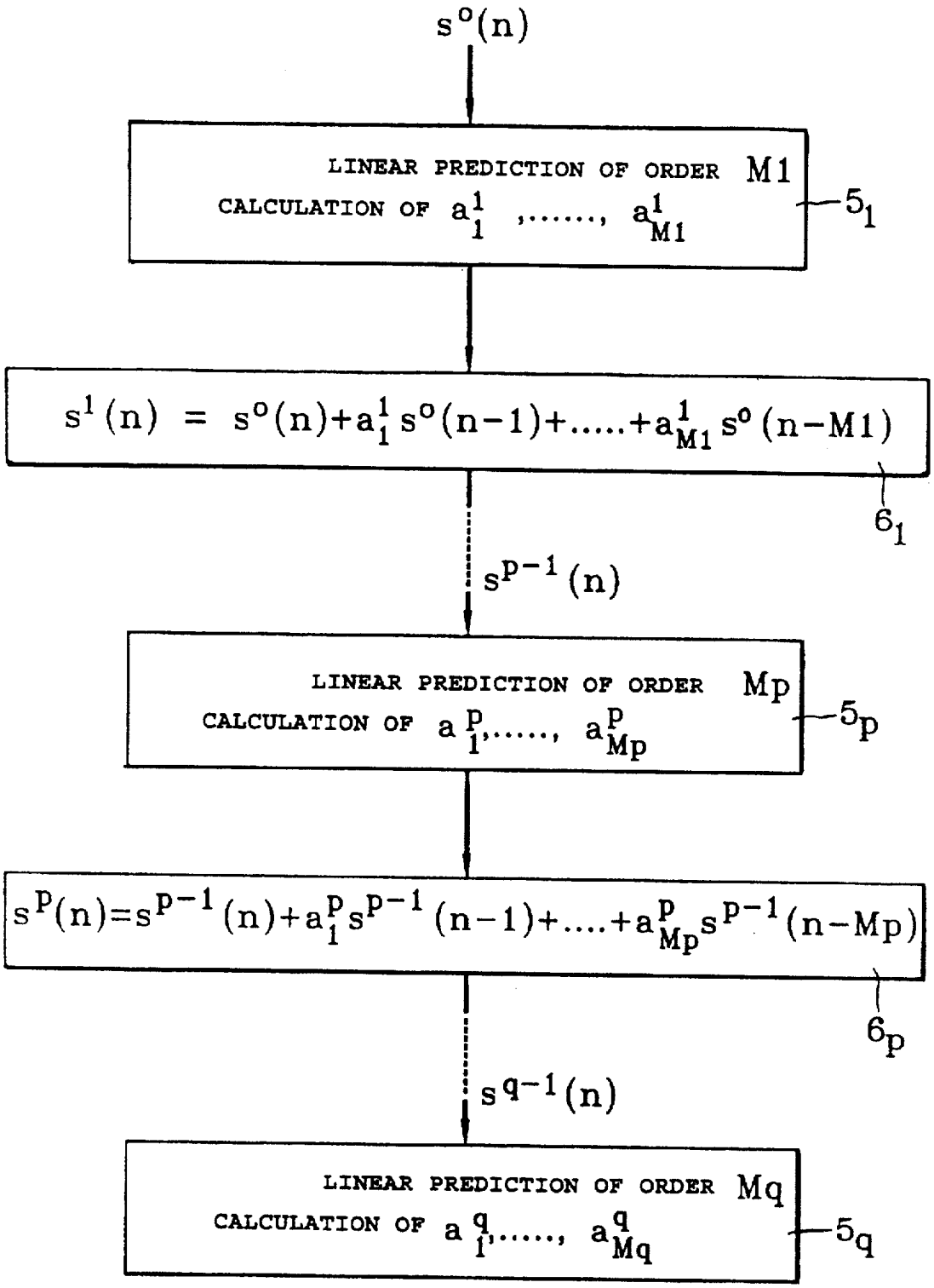
FIG. 1 is a flow chart of a linear predictive analysis method according to the invention.

The audiofrequency signal to be analysed in the method illustrated in FIG. 1 is denoted $s^0(n)$. It is assumed to be available in the form of digital samples, the integer n denoting the successive sampling times. The linear predictive analysis method comprises q successive stages $5_1, \ldots, 5_p, \ldots, 5_q$. At each prediction stage $5_p$ $(1 \leqq p \leqq q)$, linear prediction of order Mp of an input signal $s^{p-1}(n)$ is carried out. The input signal of the first stage $5_1$ consists of the audiofrequency signal $s^0(n)$ to be analysed, while the input signal of a stage $5_{p+1}$ ($1 \leqq p < q$) consists of the signal $s^p(n)$ obtained at a stage denoted $6_p$ by applying filtering to the input signal $s^{p-1}(n)$ of the p-th stage $5_p$, using a filter with transfer function $$A^p(z) = 1 + \sum_{i=1}^{Mp} a_i^p \cdot z^{-i}. \tag{4}$$

where the coefficients $a_i^p$ ($1 \leqq i \leqq Mp$) are the linear prediction coefficients obtained at the stage $5_p$.

The linear predictive analysis methods which can be employed in the various stages $5_1, \ldots, 5_q$ are well-known in the art.

Reference may, for example, be made to the works "Digital Processing of Speech Signals" by L. R. Rabiner and R. W. Shafer, Prentice-Hall Int., 1978 and "Linear Prediction of Speech" by J. D. Markel and A. H. Gray, Springer Verlag Berlin Heidelberg, 1976. In particular, use may be made of the Levinson-Durbin algorithm, which includes the following steps (for each stage $5_p$):

evaluation of Mp autocorrelations R(i) ($0 \leqq i \leqq Mp$) of the input signal $s^{p-1}(n)$ of the stage over an analysis window of Q samples:

$$R(i) = \sum_{n=i}^{Q-1} s^*(n) \cdot s^*(n-i)$$

with $s^*(n) = a^{p-1}(n).f(n)$, f(n) denoting a windowing function of length Q, for example a square-wave function or a Hamming function;

recursive evaluation of the coefficients $a_i^p$:

E(0)=R(0)

for i from 1 to Mp, taking $$r_i^p = \left[ R(i) + \sum_{j=1}^{i-1} a_j^{p,i-1} \cdot R(i-j) \right] / E(i-1)$$

$$a_i^{p,i} = -r_i^p$$

$$E(i) = [1-(r_i^p)^2] E(i-1)$$

for j from 1 to i−1, taking $$a_j^{p,i} = a_j^{p,i-1} - r_i^p . a_{i-j}^{p,i-1}$$

The coefficients $a_i^p$ (i=1, . . . , Mp) are taken to be equal to $a_i^{p,Mp}$ obtained at the last iteration. The quantity E(Mp) is the energy of the residual prediction error of stage p. The coefficients $r_i^p$, lying between −1 and 1, are referred to as reflection coefficients. They may be represented by the log-area ratios $LAR_i^p = LAR(r_i^p)$, the function LAR being defined by $LAR(r) = \log_{10}[(1-r)/(1+r)]$.

In a number of applications, the prediction coefficients obtained need to be quantized. The quantizing may be carried out on the coefficients $a_i^p$ directly, on the associated reflection coefficients $r_i^p$ or on the log-area ratios $LAR_i^p$. Another possibility is to quantize the spectral line parameters (line spectrum pairs LSP or line spectrum frequencies LSF). The Mp spectral line frequencies $\omega_i^p$ ($1 \leqq i \leqq Mp$), normalized between 0 and π, are such that the complex numbers 1, $\exp(j\omega_2^p)$, $\exp(j\omega_4^p)$, . . . , $\exp(j\omega_{Mp}^p)$ are the roots of the polynomial $p^p(z) = A^p(z) - z^{-(MP+1)} A^p(z^{-1})$ and the complex numbers $\exp(j\omega_1^p)$, $\exp(j\omega_3^p)$, . . . , $\exp(j\omega^p_{Mp-1})$ and −1 are the roots of the polynomial $Q^p(z) = A^p(z) + z^{-(MP+1)} A^p(z^{-1})$. The quantizing may relate to the normalized frequencies $\omega_i^p$ or their cosines.

The analysis may be carried out at each prediction stage $5_p$ according to the conventional Levinson-Durbin algorithm mentioned above. Other, more recently developed algorithms giving the same results may advantageously be employed, in particular the split Levinson algorithm (see "A new Efficient Algorithm to Compute the LSP Parameters for Speech Coding", by S. Saoudi, J. M. Boucher and A. Le Guyader, Signal Processing, Vol. 28, 1992, pages 201–212), or the use of Chebyshev polynomials (see "The Computation of Line Spectrum Frequencies Using Chebyshev Polynomials", by P. Kabal and R. P. Ramachandran, IEEE Trans. on Acoustics, Speech, and Signal Processing, Vol. ASSP-34, No. 6, pages 1419–1426, December 1986).

When the multi-stage analysis represented in FIG. 1 is carried out in order to define a short-term prediction filter for the audiofrequency signal $s^0(n)$, the transfer function A(z) of this filter is given the form $$A(z) = \prod_{p=1}^{q} A^p(z) \tag{5}$$

It will be noted that this transfer function satisfies the conventional general form given by formula (1), with m=M1+ . . . +Mq. However, the coefficients $a_i$ of the function A(z) which are obtained with the multi-stage prediction process generally differ from those provided by the conventional one-stage prediction process.

The orders Mp of the linear predictions carried out preferably increase from one stage to the next: M1<M2< . . . <Mq. Thus, the shape of the spectral envelope of the signal analysed is modelled relatively coarsely at the first stage $5_1$ (for example M1=2), and this modelling is refined stage by stage without losing the overall information provided by the first stage. This avoids taking insufficient account of parameters, such as the general tilt of the spectrum, which are perceptually important, particularly in the case of wideband signals and/or signals with a high spectral dynamic range.

In a typical embodiment, the number q of successive prediction stages is equal to 2. If the objective is a synthesis filter of order M, it is then possible to take M1=2 and M2=M−2, the coefficients $a_i$ of the filter (equation (1)) being given by:

$$a_1 = a_1^1 + a_1^2 \tag{9}$$

$$a_2 = a_2^1 + a_1^1 a_1^2 + a_2^2 \tag{10}$$

$$a_k = a_2^1 a_{k-2}^2 + a_1^1 a_{k-1}^2 + a_k^2 \text{ for } 2 < k \leqq M-2 \tag{11}$$

$$a_{M-1} = a_2^1 a_{M-3}^2 + a_1^1 a_{M-2}^2 \tag{12}$$

$$a_M = a_2^1 a_{M-2}^2 \tag{13}$$

For representing and, if appropriate, quantizing the short-term spectrum, it is possible to adopt one of the sets of spectral parameters mentioned above ($a_i^p$, $r_i^p$, $LAR_i^p$, $\omega_i^p$ or $\cos \omega_i^p$ for $1 \leqq i \leqq Mp$) for each of the stages ($1 \leqq p \leqq q$), or alternatively the same spectral parameters but for the composite filter calculated according to equations (9) to (13) ($a_i$, $r_i$, $LAR_i$, $\omega_i$ or $\cos \omega_i$ for $1 \leqq i \leqq M$). The choice between these or other representation parameters depends on the constraints of each particular application.

Figure 2:
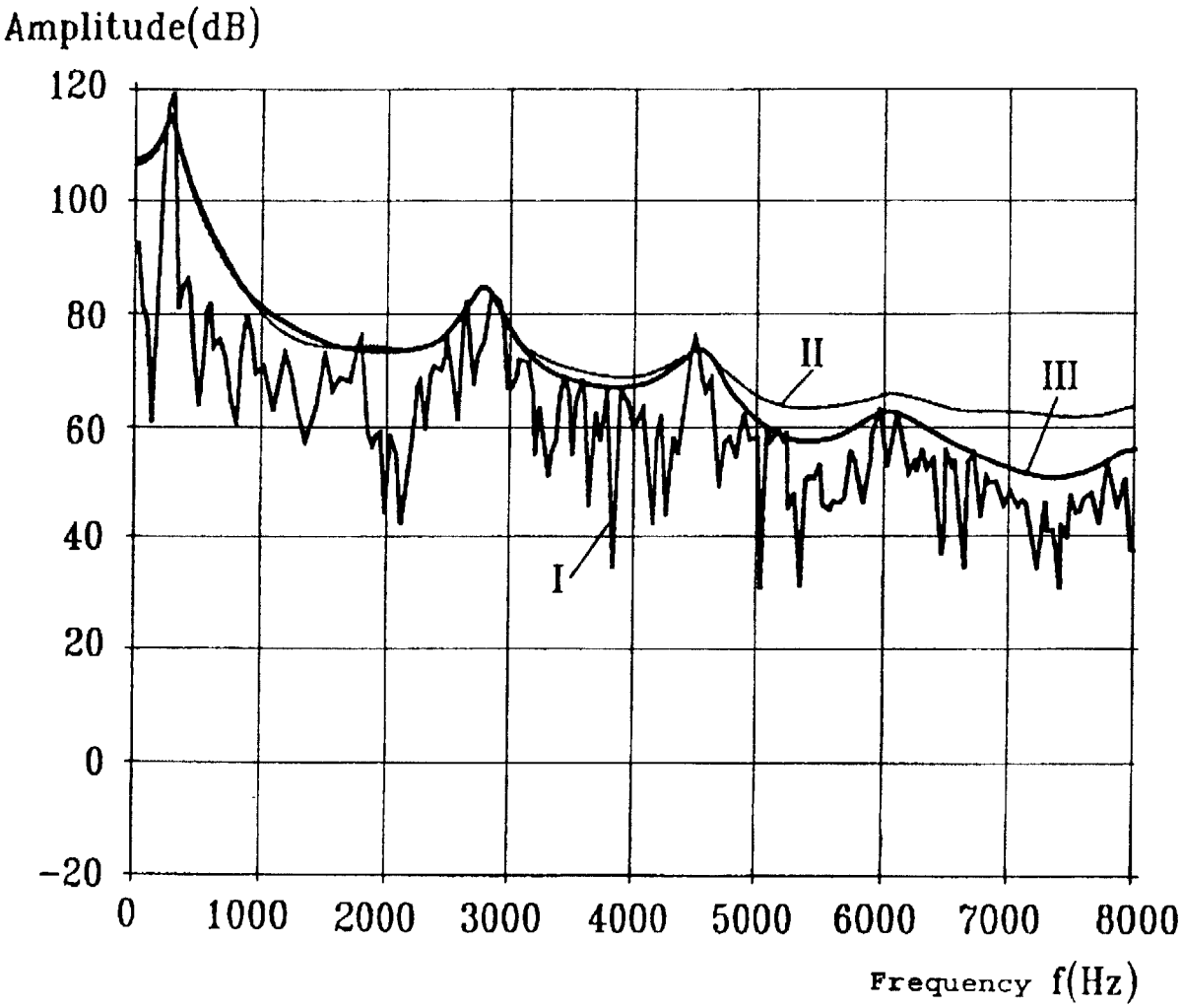
FIG. 2 is a spectral diagram comparing the results of a method according to the invention with those of a conventional linear predictive analysis method.

The graph in FIG. 2 shows a comparison of the spectral envelopes of a 30 ms spoken portion of a speech signal, which are modelled by a conventional one-stage linear prediction process with M=15 (curve II) and by a linear prediction process according to the invention in q=2 stages with M1=2 and M2=13 (curve III). The sampling frequency Fe of the signal was 16 kHz. The spectrum of the signal (modulus of its Fourier transform) is represented by the curve I. This spectrum represents audiofrequency signals which, on average, have more energy at low frequencies than at high frequencies. The spectral dynamic range is occasionally greater than that in FIG. 2 (60 dB). Curves (II) and (III) correspond to the modelled spectral envelopes $|1/A(e^{2j\pi f/Fe})|$. It can be seen that the analysis method according to the invention substantially improves the modelling of the spectrum, particularly at high frequencies (f>4 kHz). The general tilt of the spectrum and its formants at high frequency are respected better by the multi-stage analysis process.

The invention is described below in its application to a CELP-type speech coder.

Figure 3:
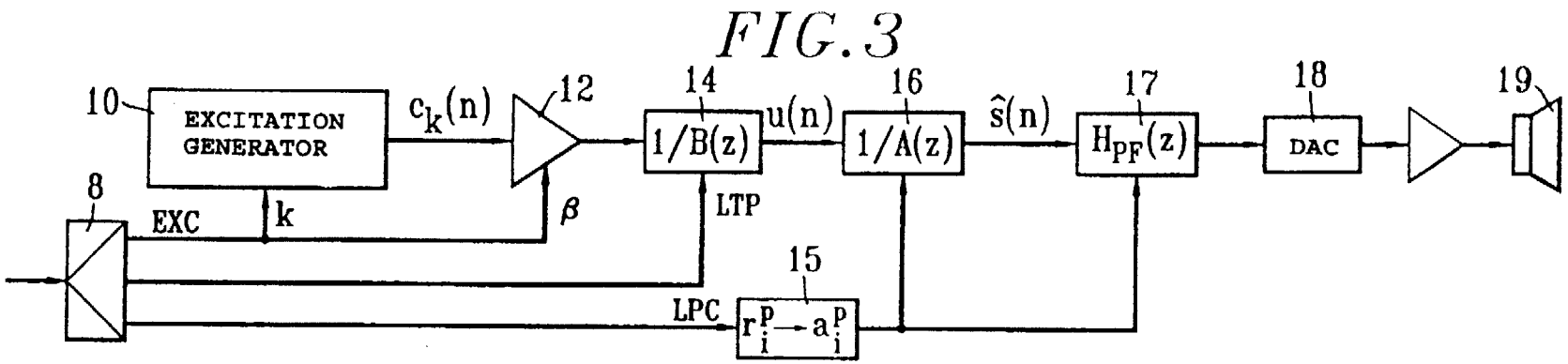
FIGS. 3 and 4 are block diagrams of a CELP decoder and coder which can implement the invention.

The speech synthesis process employed in a CELP coder and decoder is illustrated in FIG. 3. An excitation generator 10 delivers an excitation code $c_k$ belonging to a predetermined codebook in response to an index k. An amplifier 12 multiplies this excitation code by an excitation gain β, and the resulting signal is subjected to a long-term synthesis filter 14. The output signal u of the filter 14 is in turn subjected to a short-term synthesis filter 16, the output ŝ of which constitutes what is here considered as the synthetic speech signal. This synthetic signal is applied to a postfilter 17 intended to improve the subjective quality of the reconstructed speech. Postfiltering techniques are well-known in the field of speech coding (see J. H. Chen and A. Gersho: "Adaptive postfiltering for quality enhancement of coded speech", IEEE Trans. on Speech and Audio Processing, Vol. 3-1, pages 59–71, January 1995). In the example represented, the coefficients of the postfilter 17 are obtained from the LPC parameters characterizing in the short-term synthesis filter 16. It will be understood that, as in some current CELP decoders, the postfilter 17 could also include a long-term postfiltering component.

The aforementioned signals are digital signals represented, for example, by 16 bit words at a sampling rate Fe equal, for example, to 16 kHz for a wideband coder (50–7000 Hz). The synthesis filters 14, 16 are in general purely recursive filters. The long-term synthesis filter 14 typically has a transfer function of the form 1/B(z) with $B(z)=1-Gz^{-T}$. The delay T and the gain G constitute long-term prediction (LTP) parameters which are determined adaptively by the coder. The LPC parameters defining the short-term synthesis filter 16 are determined at the coder by a method of linear predictive analysis of the speech signal. In customary CELP coders and decoders, the transfer function of the filter 16 is generally of the form 1/A(z) with A(z) of the form (1). The present invention proposes adopting a similar form of the transfer function, in which A(z) is decomposed according to (7) as indicated above. By way of example, the parameters of the different stages may be q=2, M1=2, M2=13 (M=M1+M2=15).

The term "excitation signal" is here used to denote the signal u(n) applied to the short-term synthesis filter 14. This excitation signal includes an LTP component G.u(n–T) and a residual component, or innovation sequence, $\beta c_k(n)$. In an analysis-by-synthesis coder, the parameters characterizing the residual component and, optionally, the LPT component are evaluated in a closed loop, using a perceptual weighting filter.

Figure 4:
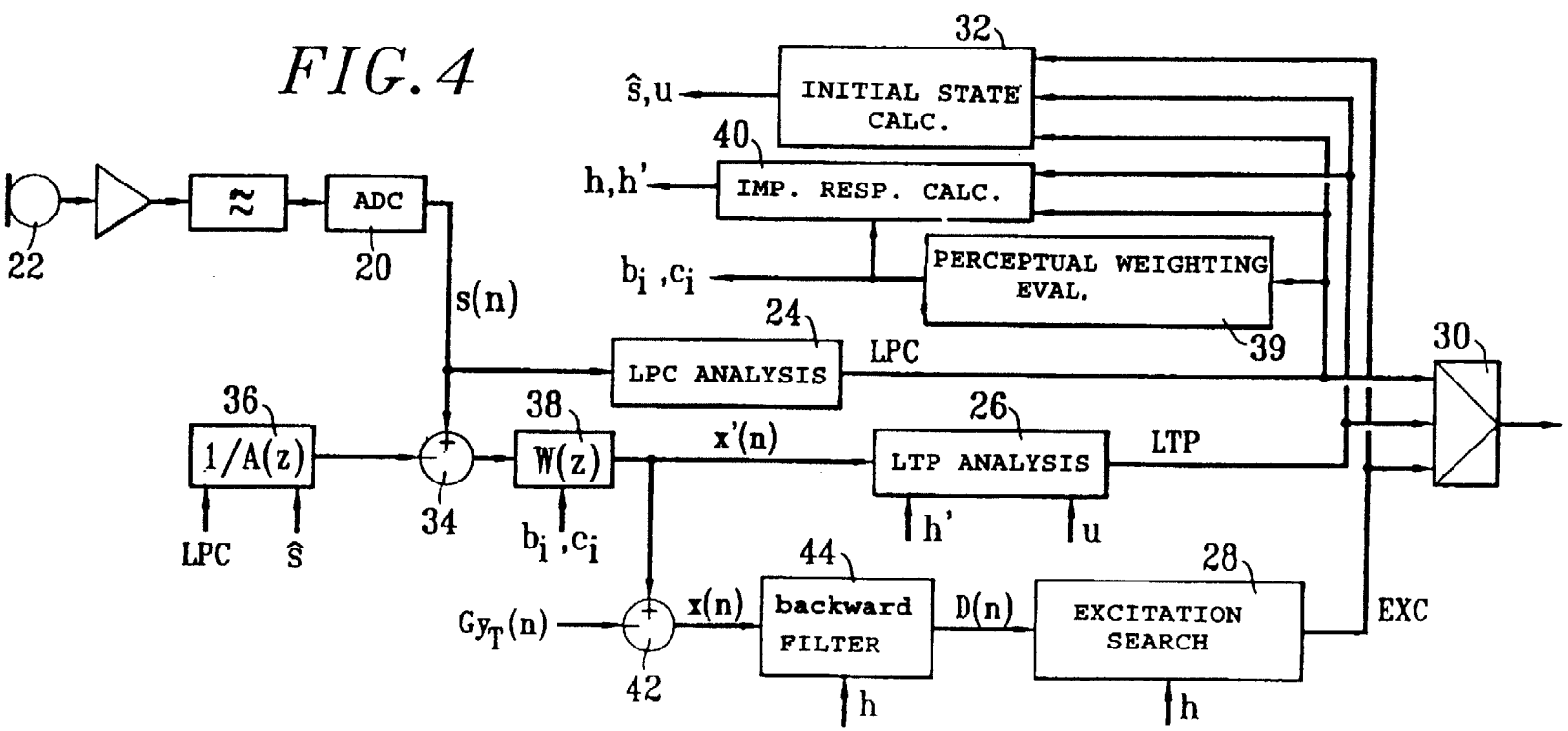

FIG. 4 shows the diagram of a CELP coder. The speech signal s(n) is a digital signal, for example provided by an analog/digital converter 20 processing the amplified and filtered output signal of a microphone 22. The signal s(n) is digitized in successive frames of A samples, themselves divided into sub-frames, or excitation frames, of L samples (for example A=160, L=32).

The LPC, LTP and EXC (index k and excitation gain β) parameters are obtained at the coder level by three respective analysis modules 24, 26, 28. These parameters are then quantized in known fashion with a view to efficient digital transmission, then subjected to a multiplexer 30 which forms the output signal of the coder. These parameters are also delivered to a module 32 for calculating initial states of certain filters of the coder. This module 32 essentially comprises a decoding chain such as the one represented in FIG. 3. Like the decoder, the module 32 operates on the basis of the quantized LPC, LTP and EXC parameters. If, as is commonplace, the LPC parameters are interpolated at the decoder, the same interpolation is carried out by the module 32. The module 32 makes it possible to know, at the coder level, the prior states of the synthesis filters 14, 16 of the decoder, which are determined as a function of the synthesis and excitation parameters prior to the sub-frame in question.

In a first step of the coding process, the short-term analysis module 24 determines the LPC parameters defining the short-term synthesis filter, by analysing the short-term correlations of the speech signal s(n). This determination is, for example, carried out once per frame of A samples, so as to adapt to the development of the spectral content of the speech signal. According to the invention, it consists in employing the analysis method illustrated by FIG. 1, with $s^0(n)=s(n)$.

The following stage of the coding consists in determining the long-term prediction LTP parameters. They are, for example, determined once per sub-frame of L samples. A subtracter 34 subtracts from the speech signal s(n) the response of the short-term synthesis filter 16 to a null input signal. This response is determined by a filter 36 with transfer function 1/A(z), the coefficients of which are given by the LPC parameters which have been determined by the module 24, and the initial states ŝ of which are provided by the module 32 so as to correspond to the M=M1+ . . . +Mq last samples of the synthetic signal. The output signal of the subtracter 34 is subjected to a perceptual weighting filter 38 whose role is to accentuate the portions of the spectrum where the errors are most perceptible, that is to say the interformant regions.

The transfer function W(z) of the perceptual weighting filter 38 is of the form W(z)=AN(z)/AP(z) where AN(z) and AP(z) are FIR-type (finite impulse response) transfer functions of order M. The respective coefficients $b_i$ and $c_i$ ($1 \leqq i \leqq M$) of the functions AN(z) and AP(z) are calculated for each frame by a perceptual weighting evaluation module 39 which delivers them to the filter 38. A first possibility is to take $AN(z)=A(z/\gamma_1)$ and $AP(z)=A(z/\gamma_2)$ with $0 \leqq \gamma_2 \leqq \gamma_1 \leqq 1$, which reduces to the conventional form (2) with A(z) of the form (7). In the case of a wideband signal with q=2, M1=2 and M2=13, it was found that the choice $\gamma_1=0.92$ and $\gamma_2=0.6$ gave good results.

However, for very little extra calculation, the invention makes it possible to have greater flexibility for the shaping of the quantizing noise, by adopting the form (6) with W(z), i.e.:

$$AN(z) = \prod_{p=1}^{q} AP(z/\gamma_1^p)$$

-continued $$AP(z) = \prod_{p=1}^{q} A^p(z/\gamma_2^p)$$

In the case of a wideband signal with q=2, M1=2 and M2=13, it was found that the choice $\gamma_1^1=0.9$, $\gamma_2^1=0.65$, $\gamma_1^2=0.95$ and $\gamma_2^2=0.75$ gave good results. The term $A^1(z/\gamma_1^1)/A^1(z/\gamma_2^1)$ makes it possible to adjust the general tilt of the filter 38, while the term $A^2(z/\gamma_1^2)/A^2(Z/\gamma_2^2)$ makes it possible to adjust the masking at the formant level.

In conventional fashion, the closed-loop LTP analysis performed by the module 26 consists, for each subframe, in selecting the delay T which maximizes the normalized correlation:

$$\left[\sum_{n=0}^{L-1} x'(n)\cdot y_T(n)\right]^2 / \left[\sum_{n=0}^{L-1} [y_T(n)]^2\right]$$

where x'(n) denotes the output signal of the filter 38 during the sub-frame in question, and $y_T(n)$ denotes the convolution product u(n−T)*h'(n). In the above expression, h'(0), h'(1), . . . , h'(L−1) denotes the impulse response of the weighted synthesis filter, of transfer function W(z)/A(z). This impulse response h' is obtained by an impulse-response calculation module 40, as a function of the coefficients $b_i$ and $c_i$ delivered by the module 39 and the LPC parameters which were determined for the sub-frame, where appropriate after quantization and interpolation. The samples u(n−T) are the prior states of the long-term synthesis filter 14, which are delivered by the module 32. For delays T shorter than the length of a sub-frame, the missing samples u(n−T) are obtained by interpolation on the basis of the prior samples, or from the speech signal. The whole or fractional delays T are selected within a defined window. In order to reduce the closed-loop search range, and therefore to reduce the number of convolutions $y_T(n)$ to be calculated, it is possible first to determine an open-loop delay T', for example once per frame, then select the closed-loop delays for each sub-frame from within a reduced interval around T'. In its simplest form, the open-loop search consists in determining the delay T' which maximizes the autocorrelation of the speech signal s(n), if appropriate filtered by the inverse filter of transfer function A(z). Once the delay T has been determined, the long-term prediction gain G is obtained by:

$$G = \left[\sum_{n=0}^{L-1} x'(n)\cdot y_T(n)\right] / \left[\sum_{n=0}^{L-1} [y_T(n)]^2\right]$$

In order to search for the CELP excitation relating to a sub-frame, the signal $Gy_T(n)$ which was calculated by the module 26 for the optimum delay T is first subtracted from the signal x'(n) by the subtracter 42. The resulting signal x(n) is subjected to a backward filter 44 which delivers a signal D(n) given by:

$$D(n) = \sum_{i=n}^{L-1} x(i)\cdot h(i-n)$$

where h(0), h(1), . . . , h(L−1), denotes the impulse response of the filter composed of the synthesis filters and the perceptual weighting filter, this response being calculated via the module 40. In other words, the composite filter has as transfer function W(z)/[A(z).B(z)]. In matrix notation, this gives:

$$D=(D(0), D(1), \ldots, D(L-1))=x.H$$

with $$x=(x(0), x(1), \ldots, x(L-1))$$

$$\text{and } H = \begin{pmatrix} h(0) & 0 & \cdots & 0 \\ h(1) & h(0) & 0 & \cdot \\ \cdot & \cdot & & \cdot \\ \cdot & \cdot & & \cdot \\ h(L-2) & \cdot & h(0) & 0 \\ h(L-1) & h(L-2) & \cdots\ h(1) & h(0) \end{pmatrix}$$

The vector D constitutes a target vector for the excitation search module 28. This module 28 determines a codeword in the codebook which maximizes the normalized correlation $P_k^2/\alpha_k^2$ in which:

$$P_k=D.c_k^T$$

$$\alpha_k^2=c_k.H^T.H.c_k^T=c_k.\ U.c_k^T$$

Once the optimum index k has been determined, the excitation gain β is taken as equal to $\beta=P_k/\alpha_k^2$.

Referring to FIG. 3, the CELP decoder comprises a demultiplexer 8 receiving the bit stream output by the coder. The quantized values of the EXC excitation parameters and of the LTP and LPC synthesis parameters are delivered to the generator 10, to the amplifier 12 and to the filters 14, 16 in order to reproduce the synthetic signal ŝ which is subjected to the postfilter 17 then converted into analog by the converter 18 before being amplified then applied to a loudspeaker 19 in order to reproduce the original speech.

In the case of the decoder in FIG. 3, the LPC parameters consist, for example, of the quantizing indices of the reflection coefficients $r_i^p$ (also referred to as the partial correlation or PARCOR coefficients) relating to the various linear prediction stages. A module 15 recovers the quantized values of the $r_i^p$ from the quantizing indices and converts them to provide the q sets of linear prediction coefficients. This conversion is, for example, carried out using the same recursive method as in the Levinson-Durbin algorithm.

The sets of coefficients $a_i^p$ are delivered to the short-term synthesis filter 16 consisting of a succession of q filters/stages with transfer functions $1/A^1(z), \ldots, 1/A^q(z)$ which are given by equation (4). The filter 16 could also be in a single stage with transfer function 1/A(z) given by equation (1), in which the coefficients $a_i$ have been calculated according to equations (9) to (13).

The sets of coefficients $a_i^p$ are also delivered to the postfilter 17 which, in the example in question, has a transfer function of the form $$H_{PF}(z) = G_P\frac{APN(z)}{APP(z)}\ (1-\mu r_1 z^{-1})$$

where APN(z) and APP(z) are FIR-type transfer functions of order M, $G_p$ is a constant gain factor, μ is a positive constant and $r_1$ denotes the first reflection coefficient.

The reflection coefficient $r_1$ may be the one associated with the coefficients $a_i$ of the composite synthesis filter, which need not then be calculated. It is also possible to take as $r_1$ the first reflection coefficient of the first prediction stage ($r_1=r_1^1$) with an adjustment of the constant μ where appropriate. For the term APN(z) /APP(z), a first possibility is to take $APN(z)=A(z/\beta_1)$ and $APP(z)=A(z/\beta_2)$ with $0 \leqq \beta_1 \leqq \beta_2 \leqq 1$, which reduces to the conventional form (3) with A(z) of the form (7).

As in the case of the perceptual weighting filter of the coder, the invention makes it possible to adopt different coefficients $\beta_1$ and $\beta_2$ from one stage to the next (equation (8)), i.e.:

$$APN(z) = \prod_{p=1}^{q} A^p(z/\beta_1^p)$$

$$APP(z) = \prod_{p=1}^{q} A^p(z/\beta_2^p)$$

In the case of a wideband signal with q=2, M1=2 and M2=13, it was found that the choice $\beta_1^1=0.7$, $\beta_2^1=0.9$, $\beta_1^2=0.95$ and $\beta_2^2=0.97$ gave good results.

Figure 5:
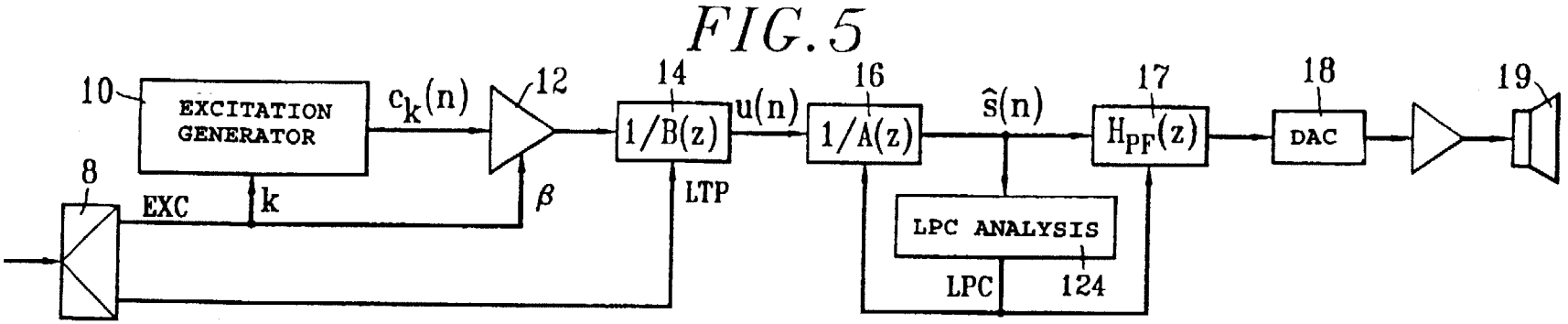
FIGS. 5 and 6 are block diagrams of CELP decoder and coder variants which can implement the invention.
Figure 6:
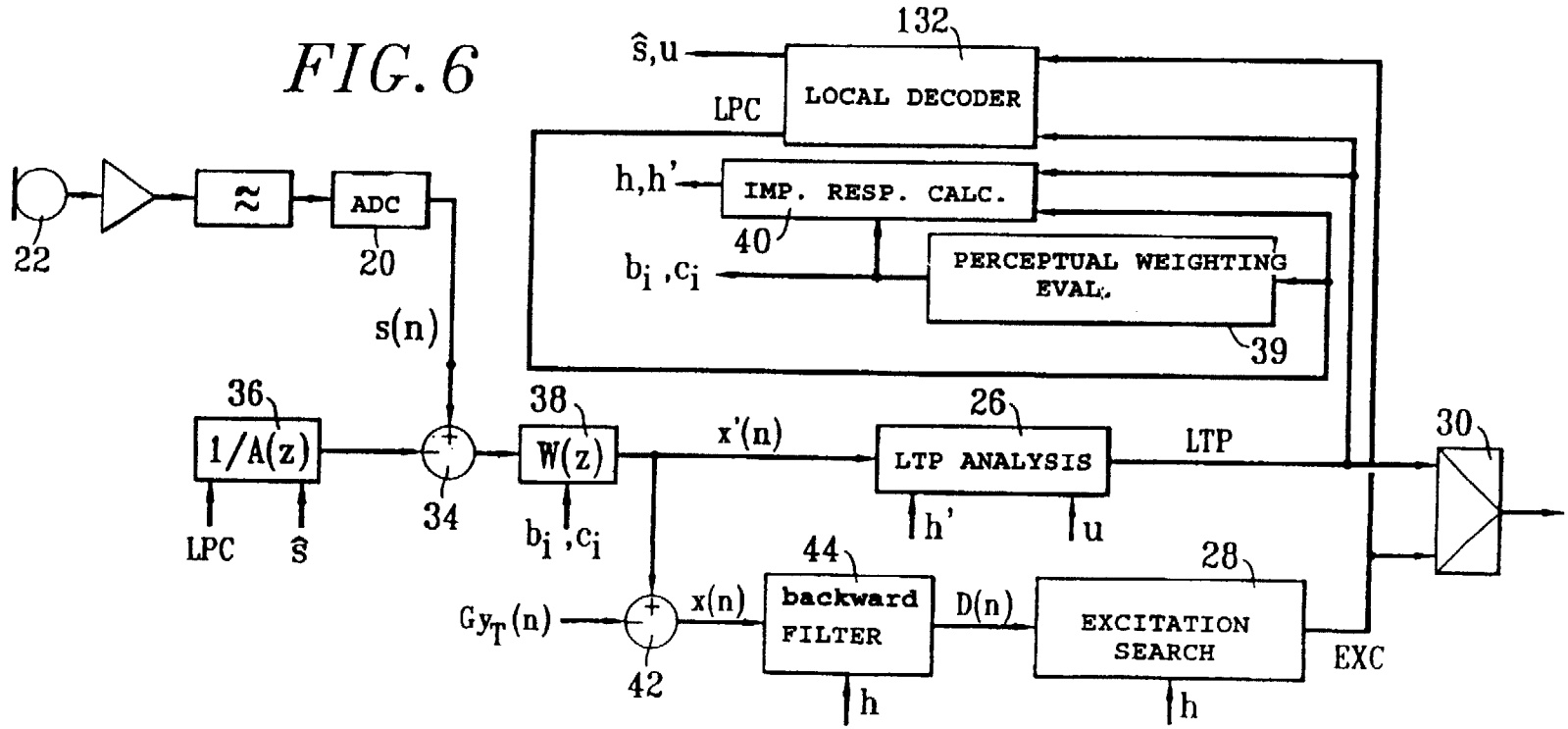

The invention has been described above in its application to a forward-adaptation predictive coder, that is to say one in which the audiofrequency signal undergoing the linear predictive analysis is the input signal of the coder. The invention also applies to backward-adaptation predictive coders/decoders, in which the synthetic signal undergoes linear predictive analysis at the coder and the decoder (see J. H. Chen et al.: "A Low-Delay CELP Coder for the CCITT 16 kbit/s Speech Coding Standard", IEEE J. SAC, Vol. 10, No. 5, pages 830–848, June 1992). FIGS. 5 and 6 respectively show a backward-adaptation CELP decoder and CELP coder implementing the present invention. Numerical references identical to those in FIGS. 3 and 4 have been used to denote similar elements.

The backward-adaptation decoder receives only the quantization values of the parameters defining the excitation signal u(n) to be applied to the short-term synthesis filter 16. In the example in question, these parameters are the index k and the associated gain β, as well as the LTP parameters. The synthetic signal ŝ(n) is processed by a multi-stage linear predictive analysis module 124 identical to the module 24 in FIG. 3. The module 124 delivers the LPC parameters to the filter 16 for one or more following frames of the excitation signal, and to the postfilter 17 whose coefficients are obtained as described above.

The corresponding coder, represented in FIG. 6, performs multi-stage linear predictive analysis on the locally generated synthetic signal, and not on the audiosignal s(n). It thus comprises a local decoder 132 consisting essentially of the elements denoted 10, 12, 14, 16 and 124 of the decoder in FIG. 5. Further to the samples u of the adaptive dictionary and the initial states ŝ of the filter 36, the local decoder 132 delivers the LPC parameters obtained by analysing the synthetic signal, which are used by the perceptual weighting evaluation module 39 and the module 40 for calculating the impulse responses h and h'. For the rest, the operation of the coder is identical to that of the coder described with reference to FIG. 4, except that the LPC analysis module 24 is no longer necessary. Only the EXC and LTP parameters are sent to the decoder.

Figure 7:
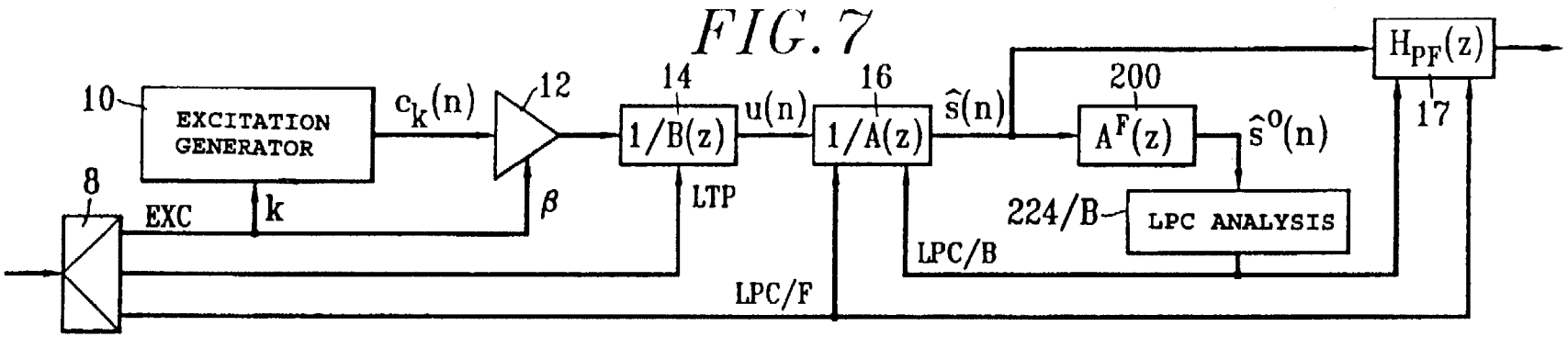
FIGS. 7 and 8 are block diagrams of other CELP decoder and coder variants which can implement the invention.
Figure 8:
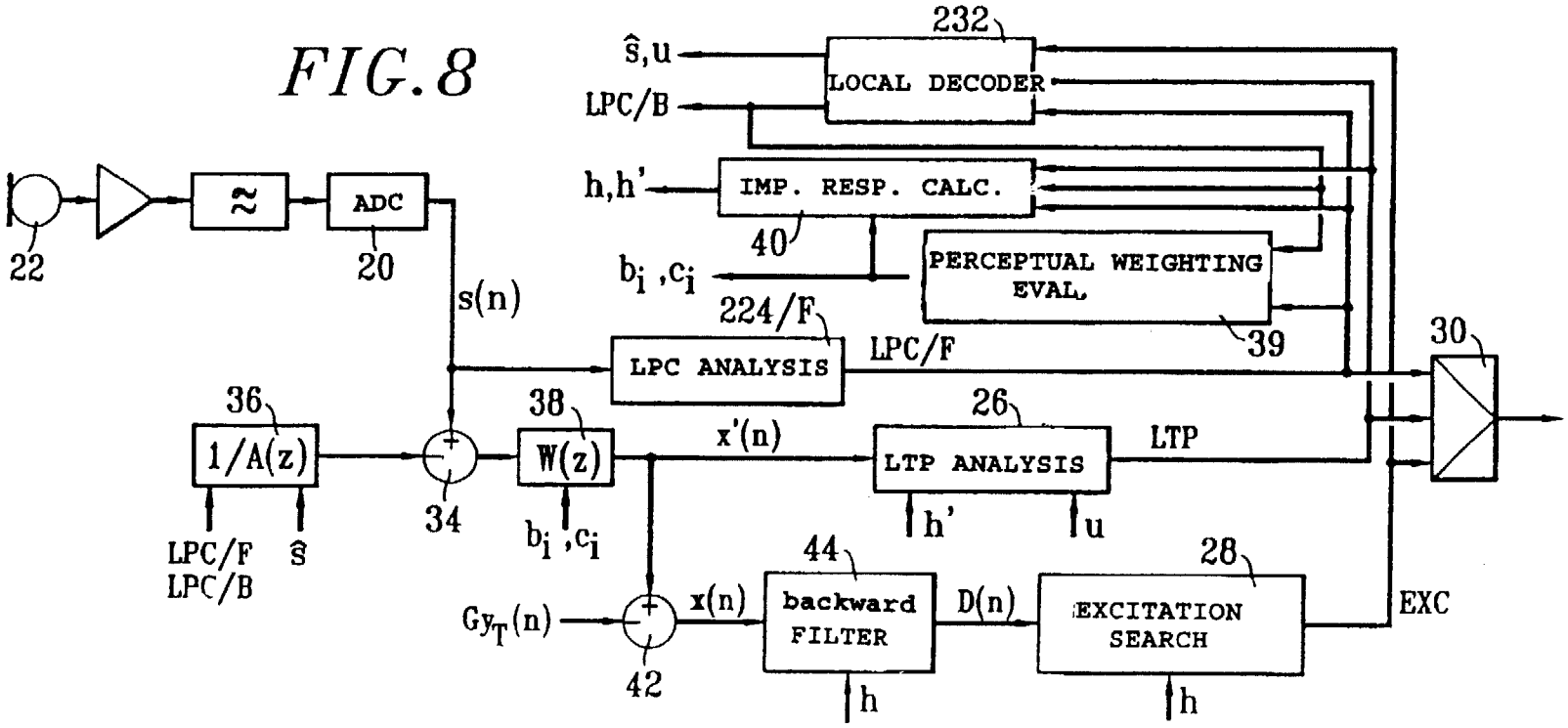

FIGS. 7 and 8 are block diagrams of a CELP decoder and a CELP coder with mixed adaptation. The linear prediction coefficients of the first stage or stages result from a forward analysis of the audiofrequency signal, performed by the coder, while the linear prediction coefficients of the last stage or stages result from a backward analysis of the synthetic signal, performed by the decoder (and by a local decoder provided in the coder). Numerical references identical to those in FIGS. 3 to 6 have been used to denote similar elements.

The mixed decoder illustrated in FIG. 7 receives the quantization values of the EXC, LTP parameters defining the excitation signal u(n) to be applied to the short-term synthesis filter 16, and the quantization values of the LPC/F parameters determined by the forward analysis performed by the coder. These LPC/F parameters represent $q_F$ sets of linear prediction coefficients $a_1^{F,p}, \ldots, a_{MFp}^{F,p}$ for $1 \leqq p \leqq q_F$, and define a first component $1/A^F(z)$ of the transfer function 1/A(z) of the filter 16:

$$A^F(z) = \prod_{p=1}^{q_F} A^{F,p}(z) = \prod_{p=1}^{q_F} \left[ 1 + \sum_{i=1}^{MFp} a_i^{F,p} \cdot z^{-i} \right];$$

In order to obtain these LPC/F parameters, the mixed coder represented in FIG. 8 includes a module 224/F which analyses the audiofrequency signal s(n) to be coded, in the manner described with reference to FIG. 1 if $q_F>1$, or in a single stage if $q_F=1$.

The other component $1/A^B(z)$ of the short-term synthesis filter 16 with transfer function $1/A(z)=1/[A^F(z).A^B(Z)]$ is given by $$A^B(z) = \prod_{p=1}^{q_B} A^{B,p}(z) = \prod_{p=1}^{q_B} \left( 1 + \sum_{i=1}^{MBp} a_i^{B,p} \cdot z^{-i} \right)$$

In order to determine the coefficients $a_i^{B,p}$, the mixed decoder includes an inverse filter 200 with transfer function $A^F(z)$ which filters the synthetic signal ŝ(n) produced by the short-term synthesis filter 16, in order to produce a filtered synthetic signal $\hat{s}^0(n)$. A module 224/B performs linear predictive analysis of this signal $\hat{s}^0(n)$ in the manner described with reference to FIG. 1 if $q_B>1$, or in a single stage if $q_B=1$. The LPC/B coefficients thus obtained are delivered to the synthesis filter 16 in order to define its second component for the following frame. Like the LPC/F coefficients, they are also delivered to the postfilter 17, the components APN(z) and APP(z) of which are either of the form $APN(z)=A(z/\beta_1)$, $APP(z)=A(z/\beta_2)$, or of the form:

$$APN(z) = \left[ \prod_{p=1}^{q_F} A^{F,p}(z/\beta_1^{F,p}) \right] \cdot \left[ \prod_{p=1}^{q_B} A^{B,p}(z/\beta_1^{B,p}) \right]$$

$$APP(z) = \left[ \prod_{p=1}^{q_F} A^{F,p}(z/\beta_2^{F,p}) \right] \cdot \left[ \prod_{p=1}^{q_B} A^{B,p}(z/\beta_2^{B,p}) \right]$$

the pairs of coefficients $\beta_1^{F,p}$, $\beta_2^{F,p}$ and $\beta_1^{B,p}$, $\beta_2^{B,p}$ being optimizable separately with $0 \leqq \beta_1^{F,p} \leqq \beta_2^{F,p} \leqq 1$ and $0 \leqq \beta_1^{B,p} \leqq \beta_2^{B,p} \leqq 1$.

The local decoder 232 provided in the mixed coder consists essentially of the elements denoted 10, 12, 14, 16, 200 and 224/B of the decoder in FIG. 7. Further to the samples u of the adaptive dictionary and the initial states ŝ of the filter 36, the local decoder 232 delivers the LPC/B parameters which, with the LPC/F parameters delivered by the analysis module 224/F, are used by the perceptual weighting evaluation module 39 and the module 40 for calculating the impulse responses h and h'.

The transfer function of the perceptual weighting filter 38, evaluated by the module 39, is either of the form $W(z)=A(z/\gamma_1)/A(z/\gamma_2)$, or of the form $$W(z) = \left[ \prod_{p=1}^{q_F} \left[ \frac{A^{F,p}(z/\gamma_1^{F,p})}{A^{F,p}(z/\gamma_2^{F,p})} \right] \right] \cdot \left[ \prod_{p=1}^{q_B} \left[ \frac{A^{B,p}(z/\gamma_1^{B,p})}{A^{B,p}(z/\gamma_2^{B,p})} \right] \right]$$

the pairs of coefficients $\gamma_1^{F,p}$, $\gamma_2^{F,p}$ and $\gamma_1^{B,p}$, $\gamma_2^{B,p}$ being optimizable separately with $0 \leqq \gamma_2^{F,p} \leqq \gamma_2^{F,p} \leqq 1$ and $0 \leqq \gamma_2^{B,p} \leqq \gamma_1^{B,p} \leqq 1$.

For the rest, the operation of the mixed coder is identical to that of the coder described with reference to FIG. 4. Only the EXC, LTP and LPC/F parameters are sent to the decoder.

We claim:

1. Method for linear predictive analysis of an audiofrequency signal, in order to determine spectral parameters dependent on a short-term spectrum of the audiofrequency signal, the method comprising q successive prediction stages, q being an integer greater than 1, wherein each prediction stage $p(1 \leqq p \leqq q)$ includes determining parameters representing a number Mp, predefined for each stage p, of linear prediction coefficients $a_1^p, \ldots, a_{Mp}^p$ of an input signal of said stage, wherein the audiofrequency signal to be analysed constitutes the input signal of stage 1, and wherein, for any integer p such that $1 \leqq p \leqq q$, the input signal of stage p+1 consists of the input signal of stage p filtered by a filter with transfer function $$A^p(z) = 1 + \sum_{i=1}^{Mp} a_i^p \cdot z^{-i},$$

2. Analysis method according to claim 1, wherein the number Mp of linear prediction coefficients increases from one stage to the next.

3. Method for coding an audiofrequency signal, comprising the following steps:

linear predictive analysis of the audiofrequency signal digitized in successive frames in order to determine parameters defining a short-term synthesis filter;

determination of excitation parameters defining an excitation signal to be applied to the short-term synthesis filter in order to produce a synthetic signal representing the audiofrequency signal; and production of quantization values of the parameters defining the short-term synthesis filter and of the excitation parameters, wherein the linear predictive analysis is a process with q successive stages, q being an integer greater than 1, wherein each prediction stage $p(1 \leqq p \leqq q)$ includes determining parameters representing a number Mp, predefined for each stage p, of linear prediction coefficients $a_1^p, \ldots, a_{Mp}^p$ of an input signal of said stage, wherein the audiofrequency signal to be coded constitutes the input signal of stage 1, wherein, for any integer p such that $1 \leqq p \leqq q$, the input signal of stage p+1 consists of the input signal of stage p filtered by a filter with transfer function $$A^p(z) = 1 + \sum_{i=1}^{Mp} a_i^p \cdot z^{-i},$$

and wherein the short-term synthesis filter has a transfer function of the form 1/A(z) with $$A(z) = \prod_{p=1}^{q} A^p(z)$$

4. Coding method according to claim 3, wherein the number Mp of linear prediction coefficients increases from one stage to the next.

5. Coding method according to claim 3, wherein at least some of the excitation parameters are determined by minimizing an energy of an error signal resulting from a filtering of a difference between the audiofrequency signal and the synthetic signal by at least one perceptual weighting filter having a transfer function of the form $W(z)=A(z/\gamma_1)/A(z/\gamma_2)$ where $\gamma_1$ and $\gamma_2$ denote spectral expansion coefficients such that $0 \leqq \gamma_2 \leqq \gamma_1 \leqq 1$.

6. Coding method according to claim 3, wherein at least some of the excitation parameters are determined by minimizing an energy of an error signal resulting from a filtering of a difference between the audiofrequency signal and the synthetic signal by at least one perceptual weighting filter having a transfer function of the form $$W(z) = \prod_{p=1}^{q} [A^p(z/\gamma_1^p)/A^p(z/\gamma_2^p)],$$

where $\gamma_1^p$, $\gamma_1^p$ denote pairs of spectral expansion coefficients such that $0 \leqq \gamma_2^p \leqq \gamma_1^p \leqq 1$ for $1 \leqq p \leqq q$.

7. Method for decoding a bit stream in order to construct an audiofrequency signal coded by said bit stream, comprising the steps of:

receiving quantization values of parameters defining a short-term synthesis filter and of excitation parameters, wherein the parameters defining the synthesis filter represent a number q greater than 1 of sets of linear prediction coefficients, each set $p(1 \leqq p \leqq q)$ including a predefined number Mp of coefficients;

producing an excitation signal on the basis of the quantization values of the excitation parameters; and producing a synthetic audiofrequency signal by filtering the excitation filter with a synthesis filter having a transfer function of the form 1/A(z) with $$A(z) = \prod_{p=1}^{q} \left( 1 + \sum_{i=1}^{Mp} a_i^p \cdot z^{-i} \right)$$

where the coefficients $a_1^p, \ldots, a_{Mp}^p$ correspond to the p-th set of linear prediction coefficients for $1 \leqq p \leqq q$.

8. Decoding method according to claim 7, further comprising the step of applying said synthetic audiofrequency signal to a postfilter whose transfer function includes a term of the form $A(z/\beta_1)/A(z/\beta_2)$, where $\beta_1$ and $\beta_1$ denote coefficients such that $0 \leqq \beta_1 \leqq \beta_2 \leqq 1$.

9. Decoding method according to claim 7, further comprising the step of applying said synthetic audiofrequency signal to a postfilter whose transfer function includes a term of the form $$\prod_{p=1}^{q} [A^p(z/\beta_1^p)/A^p(z/\beta_2^p)],$$

where $\beta_1^p$, $\beta_2^p$ denote pairs of coefficients such that $0 \leqq \beta_1^p \leqq \beta_2^p \leqq 1$ for $1 \leqq p \leqq q$, and $A^p(z)$ represents, for the p-th set of linear prediction coefficients, the function $$A^p(z) = 1 + \sum_{i=1}^{Mp} a_i^p \cdot z^{-i}$$

10. Method for coding a first audiofrequency signal digitized in successive frames, comprising the following steps:

linear predictive analysis of a second audiofrequency signal in order to determine parameters defining a short-term synthesis filter;

determination of excitation parameters defining an excitation signal to be applied to the short-term synthesis filter in order to produce a synthetic signal representing the first audiofrequency signal, said synthetic signal constituting said second audiofrequency signal for at least one subsequent frame; and production of quantization values of the excitation parameters, wherein the linear predictive analysis is a process with q successive stages, q being an integer greater than 1, wherein each prediction stage $p(1 \leqq p \leqq q)$ includes determining parameters representing a number Mp, predefined for each stage p, of linear prediction coefficients $a_1^p, \ldots, a_{Mp}^p$ of an input signal of said stage, wherein the second audiofrequency signal constitutes the input signal of stage 1, wherein, for any integer p such that $1 \leqq p \leqq q$, the input signal of stage p+1 consists of the input signal of stage p filtered by a filter with transfer function $$A^p(z) = 1 + \sum_{i=1}^{Mp} a_i^p \cdot z^{-i},$$

and wherein the short-term synthesis filter has a transfer function of the form 1/A(z) with $$A(z) = \prod_{p=1}^{q} A^p(z).$$

11. Coding method according to claim 10, wherein the number Mp of linear prediction coefficients increases from one stage to the next.

12. Coding method according to claim 10, wherein at least some of the excitation parameters are determined by minimizing an energy of an error signal resulting from a filtering of a difference between the first audiofrequency signal and the synthetic signal by at least one perceptual weighting filter having a transfer function of the form $W(z)=A(z/\gamma_1)/A(z/\gamma_2)$ where $\gamma_1$ and $\gamma_2$ denote spectral expansion coefficients such that $0 \leqq \gamma_2 \leqq \gamma_1 \leqq 1$.

13. Coding method according to claim 10, wherein at least some of the excitation parameters are determined by minimizing an energy of an error signal resulting from a filtering of a difference between the first audiofrequency signal and the synthetic signal by at least one perceptual weighting filter having a transfer function of the form $$W(z) = \prod_{p=1}^{q} [A^p(z/\gamma_1^p)/A^p(z/\gamma_2^p)],$$

where $\gamma_1^p$, $\gamma_2^p$ denote pairs of spectral expansion coefficients such that $0 \leqq \gamma_2^p \leqq \gamma_1^p \leqq 1$ for $1 \leqq p \leqq q$.

14. Method for decoding a bit stream in order to construct in successive frames an audiofrequency signal coded by said bit stream, comprising the steps of:

receiving quantization values of excitation parameters;

producing an excitation signal on the basis of the quantization values of the excitation parameters;

producing a synthetic audiofrequency signal by filtering the excitation signal with a short-term synthesis filter; and performing a linear predictive analysis of the synthetic signal in order to obtain coefficients of the short-term synthesis filter for at least one subsequent frame, wherein the linear predictive analysis is a process with q successive stages, q being an integer greater than 1, wherein each prediction stage $p(1 \leqq p \leqq q)$ includes determining parameters representing a number Mp, predefined for each stage p, of linear prediction coefficients $a_1^p, \ldots, a_{Mp}^p$ of an input signal of said stage, wherein the synthetic signal constitutes the input signal of stage 1, wherein, for any integer p such that $1 \leqq p \leqq q$, the input signal of stage p+1 consists of the input signal of stage p filtered by a filter with transfer function $$A^p(z) = 1 + \sum_{i=1}^{Mp} a_i^p \cdot z^{-i},$$

and wherein the short-term synthesis filter has a transfer function of the form 1/A(z) with $$A(z) = \prod_{p=1}^{q} A^p(z).$$

15. Decoding method according to claim 14, further comprising the step of applying said synthetic audiofrequency signal to a postfilter whose transfer function includes a term of the form $A(z/\beta_1/A(z/\beta_2)$, where $\beta_1$ and $\beta_2$ denote coefficients such that $0 \leqq \beta_1 \leqq \beta_2 \leqq 1$.

16. Decoding method according to claim 14, further comprising the step of applying said synthetic audiofrequency signal to a postfilter whose transfer function includes a term of the form $$\prod_{p=1}^{q} [A^p(z/\beta_1^p)/A^p(z/\beta_2^p)],$$

where $\beta_1^p$, $\beta_2^p$ denote pairs of coefficients such that $0 \leqq \beta_1^p \leqq \beta_2^p \leqq 1$ for $1 \leqq p \leqq q$.

17. Method for coding a first audiofrequency signal digitized in successive frames, comprising the following steps:

linear predictive analysis of the first audiofrequency signal in order to determine parameters defining a first component of a short-term synthesis filter;

determination of excitation parameters defining an excitation signal to be applied to the short-term synthesis filter in order to produce a synthetic signal representing the first audiofrequency signal;

production of quantization values of the parameters defining the first component of the short-term synthesis filter and of the excitation parameters;

filtering of the synthetic signal with a filter with transfer function corresponding to the inverse of the transfer function of the first component of the short-term synthesis filter; and linear predictive analysis of the filtered synthetic signal in order to obtain coefficients of a second component of the short-term synthesis filter for at least one subsequent frame, wherein the linear predictive analysis of the first audiofrequency signal is a process with $q_F$ successive stages, $q_F$ being an integer at least equal to 1, wherein each prediction stage $p(1 \leqq p \leqq q_F)$ of said process with $q_F$ stages includes determining parameters representing a number MFp, predefined for each stage p, of linear prediction coefficients $A_1^{F,p}, \ldots, a_{MFp}^{F,p}$ of an input signal of said stage, wherein the first audiofrequency signal constitutes the input signal of stage 1 of the process with $q_F$ stages, wherein, for any integer p such that $1 \leqq p < q_F$, the input signal of stage p+1 of the process with $q_F$ stages consists of the input signal of stage p of the process with $q_F$ stages filtered by a filter with transfer function $$A^{F,p}(z) = 1 + \sum_{i=1}^{MFp} a_i^{F,p} \cdot z^{-i},$$

wherein the first component of the short-term synthesis filter has a transfer function of the form $1/A^F(z)$ with $$A^F(z) = \prod_{p=1}^{q_F} A^{F,p}(z),$$

wherein the linear predictive analysis of the filtered synthetic signal is a process with $q_B$ successive stages, $q_B$ being an integer at least equal to 1, wherein each prediction stage $p(1 \leqq p \leqq q_B)$ of said process with $q_B$ stages includes determining parameters representing a number MBp, predefined for each stage p, of linear prediction coefficients $a_1^{b,p}, \ldots, a_{MBp}^{B,p}$ of an input signal of said stage, wherein the filtered synthetic signal constitutes the input signal of stage 1 of the process with $q_B$ stages, wherein, for any integer p such that $1 \leqq p < q_B$, the input signal of stage p+1 of the process with $q_B$ stages consists of the input signal of stage p of the process with $q_B$ stages filtered by a filter with transfer function $$A^{B,p}(z) = 1 + \sum_{i=1}^{MBp} a_i^{B,p} \cdot z^{-i},$$

wherein the second component of the short-term synthesis filter has a transfer function of the form $1/A^B(z)$ with $$A^B(z) = \prod_{p=1}^{q_B} A^{B,p}(z),$$

and wherein the short-term synthesis filter has a transfer function of the form $1/A(z)$ with $A(z)=A^F(z).A^B(z)$.

18. Coding method according to claim 17, wherein at least some of the excitation parameters are determined by minimizing an energy of an error signal resulting from a filtering of a difference between the first audiofrequency signal and the synthetic signal by at least one perceptual weighting filter having a transfer function of the form $W(z)=A(z/\gamma_1)/A(z/\gamma_2)$ where $\gamma_1$ and $\gamma_2$ denote spectral expansion coefficients such that $0 \leqq \gamma_2 \leqq \gamma_1 \leqq 1$.

19. Coding method according to claim 17, wherein at least some of the excitation parameters are determined by minimizing an energy of an error signal resulting from a filtering of a difference between the first audiofrequency signal and the synthetic signal by at least one perceptual weighting filter having a transfer function of the form $$W(z) = \left[ \prod_{p=1}^{q_F} \left[ \frac{A^{F,p}(z/\gamma_1^{F,p})}{A^{F,p}(z/\gamma_2^{F,p})} \right] \right] \cdot \left[ \prod_{p=1}^{q_B} \left[ \frac{A^{B,p}(z/\gamma_1^{B,p})}{A^{B,p}(z/\gamma_2^{B,p})} \right] \right]$$

where $\gamma_1^{F,p}$, $\gamma_2^{F,p}$ denote pairs of spectral expansion coefficients such that $0 \leqq \gamma_2^{F,p} \leqq \gamma_1^{F,p} \leqq 1$ for $1 \leqq p \leqq q_F$, and $\gamma_1^{B,p}$, $\gamma_2^{B,p}$ denote pairs of spectral expansion coefficients such that $0 \leqq \gamma_2^{B,p} \leqq \gamma_1^{B,p} \leqq 1$ for $1 \leqq p \leqq q_B$.

20. Method for decoding a bit stream in order to construct in successive frames an audiofrequency signal coded by said bit stream, comprising the steps of:

receiving quantization values of parameters defining a first component of a short-term synthesis filter and of excitation parameters, wherein the parameters defining the first component of the short-term synthesis filter represent a number $q_F$ at least equal to 1 of sets of linear prediction coefficients $a_1^{F,p}, \ldots a_{MFp}^{F,p}$ for $1 \leqq p \leqq q_F$, each set p including a predefined number MFp of coefficients, wherein the first component of the short-term synthesis filter has a transfer function of the form $1/A^F(z)$ with $$A^F(z) = \prod_{p=1}^{q_F} A^{F,p}(z) = \prod_{p=1}^{q_F} \left( 1 + \sum_{i=1}^{MFp} a_i^{F,p} \cdot z^{-i} \right);$$

producing an excitation signal on the basis of the quantization values of the excitation parameters;

producing a synthetic audiofrequency signal by filtering the excitation signal with a short-term synthesis filter having a transfer function $1/A(z)$ with $A(z)=A^F(z).A^B(z)$, where $1/A^B(z)$ represents a transfer function of a second component of the short-term synthesis filter;

filtering the synthetic signal with a filter with transfer function $A^F(z)$; and performing a linear predictive analysis of the filtered synthetic signal in order to obtain coefficients of the second component of the short-term synthesis filter for at least one subsequent frame, wherein the linear predictive analysis of the filtered synthetic signal is a process with $q_B$ successive stages, $q_B$ being an integer at least equal to 1, wherein each prediction stage $p(1 \leqq p \leqq q_B)$ includes determining parameters representing a number MBp, predefined for each stage p, of linear prediction coefficients $a_1^{B,p}, \ldots, a_{MBp}^{B,p}$ of an input signal of the said stage, wherein the filtered synthetic signal constitutes the input signal of stage 1, wherein, for any integer p such that $1 \leqq p < q_B$, the input signal of stage p+1 consists of the input signal of stage p filtered by a filter with transfer function $$A^{B,p}(z) = 1 + \sum_{i=1}^{MBp} a_i^{B,p} \cdot z^{-i},$$

and wherein the second component of the short-term synthesis filter has a transfer function of the form $1/A^B(z)$ with $$A^B(z) = \prod_{p=1}^{q_B} A^{B,p}(z).$$

21. Decoding method according to claim 20, further comprising the step of applying said synthetic audiofrequency signal to a postfilter whose transfer function includes a term of the form $A(z/\beta_1)/A(z/\beta_2)$, where $\beta_1$ and $\beta_2$ denote coefficients such that $0 \leqq \beta_1 \leqq \beta_2 \leqq 1$.

22. Decoding method according to claim 20, further comprising the step of applying said synthetic audiofrequency signal to a postfilter whose transfer function includes a term of the form $$\left[ \prod_{p=1}^{q_F} \left[ \frac{A^{F,p}(z/\beta_1^{F,p})}{A^{F,p}(z/\beta_2^{F,p})} \right] \right] \cdot \left[ \prod_{p=1}^{q_B} \left[ \frac{A^{B,p}(z/\beta_1^{B,p})}{A^{B,p}(z/\beta_2^{B,p})} \right] \right]$$

where $\beta_1^{F,P}$, $\beta_2^{F,P}$ denote pairs of coefficients such that $0 \leqq \beta_1^{F,p} \leqq \beta_2^{F,p} \leqq 1$ for $1 \leqq p \leqq q_F$, and $\beta_1^{B,p}$, $\beta_2^{B,p}$ denote pairs of coefficients such that $0 \leqq \beta_1^{B,p} \leqq \beta_2^{B,p} \leqq 1$ for $1 \leqq p \leqq q_B$.

* * * * *